US008453860B2

(12) United States Patent
Otero

(10) Patent No.: US 8,453,860 B2
(45) Date of Patent: Jun. 4, 2013

(54) BOTTLE WITH RATCHETING BASE AND INNER BLADDER

(75) Inventor: Efrain Otero, Rye, NY (US)

(73) Assignee: Efrain Otero, Rye, NY (US)

( * ) Notice: Subject to any disclaimer, the term of this patent is extended or adjusted under 35 U.S.C. 154(b) by 3 days.

(21) Appl. No.: 13/199,840

(22) Filed: Sep. 12, 2011

(65) Prior Publication Data

US 2013/0062302 A1 Mar. 14, 2013

(51) Int. Cl.
*B65D 23/02* (2006.01)

(52) U.S. Cl.
USPC ..... 215/391; 215/6; 215/228; 215/11.3; 215/376; 215/12.1; 215/900; 220/666; 220/495.03; 220/625

(58) Field of Classification Search
USPC ..... 206/217, 218, 535, 538; 215/6, 11.3, 215/12.1, 222, 228, 306, 370, 376–378, 383, 215/391, 900; 220/23.83, 23.86–23.89, 212, 220/213, 254.8, 375, 495.03, 506, 521–524, 220/526, 625, 666, 916; 426/85
See application file for complete search history.

(56) References Cited

U.S. PATENT DOCUMENTS

| | | | | | |
|---|---|---|---|---|---|
| 378,752 | A | * | 2/1888 | Ader | 215/6 |
| 2,204,784 | A | * | 6/1940 | Abrams | 312/31.2 |
| 2,273,210 | A | * | 2/1942 | Lowther et al. | 285/410 |
| 2,655,288 | A | * | 10/1953 | Caretto | 222/142.3 |
| 2,762,674 | A | * | 9/1956 | Sauvago | 312/305 |
| 2,843,281 | A | * | 7/1958 | Gallois | 215/11.1 |
| 3,143,205 | A | * | 8/1964 | Ruderian | 206/543 |
| 3,311,248 | A | * | 3/1967 | Marchant | 215/13.1 |
| 3,348,716 | A | * | 10/1967 | Nakata | 215/6 |
| 3,847,494 | A | * | 11/1974 | Franklin | 403/345 |
| 3,873,003 | A | * | 3/1975 | Seiferth et al. | 222/95 |
| 3,920,120 | A | * | 11/1975 | Shveda | 206/217 |
| 4,040,549 | A | * | 8/1977 | Sadler | 224/483 |
| 4,127,211 | A | * | 11/1978 | Zerbey | 220/212 |
| 4,150,766 | A | * | 4/1979 | Westendorf et al. | 221/112 |
| 4,184,601 | A | * | 1/1980 | Stewart et al. | 215/13.1 |
| 4,416,370 | A | * | 11/1983 | Beall | 206/217 |
| 4,529,517 | A | * | 7/1985 | Carlvret | 210/223 |
| 4,573,597 | A | * | 3/1986 | Adams et al. | 215/372 |
| 4,600,111 | A | * | 7/1986 | Brown | 215/6 |
| 4,603,784 | A | * | 8/1986 | Chang | 215/11.1 |
| 4,723,690 | A | * | 2/1988 | vom Hofe | 221/96 |
| 4,795,028 | A | * | 1/1989 | Wittig et al. | 206/217 |
| 4,823,946 | A | * | 4/1989 | Stoeffler et al. | 206/221 |
| 4,948,000 | A | * | 8/1990 | Grabenkort | 215/12.2 |
| 4,979,629 | A | * | 12/1990 | Askerneese | 215/11.1 |
| 4,984,723 | A | * | 1/1991 | Hsu | 224/148.4 |
| 5,040,719 | A | * | 8/1991 | Ballway | 220/738 |
| 5,056,659 | A | * | 10/1991 | Howes et al. | 206/217 |

(Continued)

*Primary Examiner* — J. Gregory Pickett
*Assistant Examiner* — Ned A Walker

(57) ABSTRACT

The purpose of the invention is to remove the excess air in an opened, partially used bottle containing effervescent beverages. Further use of the invention can be employed when viscous substances are contained. This is achieved by rotating a base of a bottle that is connected to a tab at the bottom of an inner bladder liner that is contained inside a bottle. The invention shows a bottle system for dispensing and maintaining effervescent beverages fresher for a longer period of time after a bottle has been opened. The bottle also improves the dispensing of thick substances found in many products that have viscous properties. The system offers a more efficient, easy solution for the dispensing of such substances from their containers by employing a collapsible inner bladder liner contained inside a bottle.

12 Claims, 15 Drawing Sheets

U.S. PATENT DOCUMENTS 5,056,749 A * 10/1991 Ige ..... 248/346.11
5,129,520 A * 7/1992 Gaspar ..... 206/534
5,148,682 A * 9/1992 Wolf ..... 62/59
5,150,804 A * 9/1992 Blanchet et al. ..... 220/212
5,261,554 A * 11/1993 Forbes ..... 220/592.16
5,282,541 A * 2/1994 Chen ..... 215/229
5,310,068 A * 5/1994 Saghri ..... 215/386
5,312,013 A * 5/1994 Bridges ..... 220/625
5,318,787 A * 6/1994 Brauner et al. ..... 426/120
5,370,250 A * 12/1994 Gilbert ..... 222/1
D360,338 S * 7/1995 Westgerdes ..... D7/511
5,489,043 A * 2/1996 Newman ..... 220/737
5,527,705 A * 6/1996 Mussi et al. ..... 435/297.1
5,531,353 A * 7/1996 Ward et al. ..... 220/729
5,590,774 A * 1/1997 Roberts ..... 206/366
5,647,481 A * 7/1997 Hundertmark et al. ..... 206/219
5,664,671 A * 9/1997 Nedblake, Jr. ..... 206/217
5,673,789 A * 10/1997 Degraff-Eugene ..... 206/217
5,699,921 A * 12/1997 Rodriguez ..... 215/11.5
5,732,838 A * 3/1998 Young ..... 215/384
5,938,053 A * 8/1999 Verbovszky et al. ..... 215/6
RE36,377 E * 11/1999 Gilbert ..... 215/382
6,199,699 B1 * 3/2001 Eastman ..... 206/545
6,289,906 B1 * 9/2001 Vanden Dries et al. ..... 134/117
6,405,675 B1 * 6/2002 Mills ..... 119/74
6,536,453 B2 * 3/2003 Vanden Dries et al. ..... 134/117
6,719,159 B2 * 4/2004 Chomik ..... 215/343
6,736,285 B2 * 5/2004 Stewart-Stand ..... 220/666
D496,222 S * 9/2004 Kleckauskas et al. ..... D7/507
RE38,770 E * 8/2005 Gilbert ..... 215/382
6,923,347 B2 * 8/2005 Winckels ..... 222/206
6,971,759 B2 * 12/2005 Sutton ..... 362/101
7,090,773 B2 * 8/2006 Meddock et al. ..... 210/342
7,194,951 B1 * 3/2007 Porter ..... 100/116
7,574,846 B2 * 8/2009 Sheets et al. ..... 53/440
7,802,691 B2 * 9/2010 Musalek ..... 215/381
7,900,425 B2 * 3/2011 Bysick et al. ..... 53/440
2001/0054578 A1 * 12/2001 King ..... 210/192
2002/0020437 A1 * 2/2002 Vanden Dries et al. ..... 134/117
2002/0162845 A1 * 11/2002 Yeh ..... 220/625
2004/0056037 A1 * 3/2004 Gluck ..... 220/625
2004/0065565 A1 * 4/2004 Buesching et al. ..... 206/217
2004/0262173 A1 * 12/2004 Buesching et al. ..... 206/217
2004/0262174 A1 * 12/2004 Buesching et al. ..... 206/217
2005/0269237 A1 * 12/2005 Tung et al. ..... 206/534
2006/0016819 A1 * 1/2006 Paslawski et al. ..... 220/666
2007/0181403 A1 * 8/2007 Sheets et al. ..... 198/617
2008/0035639 A1 * 2/2008 Bast et al. ..... 220/213
2009/0188884 A1 * 7/2009 Nelson et al. ..... 215/6

* cited by examiner 17
27
28
28
27
35
14
21
23
23
24
24
24
31
20
16
19
30

BOTTLE WITH RATCHETING BASE AND INNER BLADDER

CROSS REFERENCE TO RELATED APPLICATIONS

Not Applicable

STATEMENT REGARDING FEDERALLY SPONSORED RESEARCH OR DEVELOVEMENT

Not Applicable

REFERENCE TO SEQUENCE LISTING, A TABLE, OR A COMPUTER PROGRAM LISTING COMPACT DISC APPENDIX

Not Applicable

BACKGROUND

Metal and plastics have been used to contain drinks that contain effervescent properties that require pressure to preserve them to have a longer shelf life. More sophisticated kegs, bottles, and cans are employed today which have additives like nitrogen, or carbon dioxide that require tightly sealed containers that are kept under pressure. Attempts have been made to address the issue of storing these goods to retain some semblance of the freshness that they had before they were opened and partially consumed. Usually this requires a large container like a keg.

The design of the invention shows a more simple approach to the problem of dispensing and maintaining an effervescent beverage fresher for a longer period of time after it has been opened. However, the benefits of the bottle system don't end there. Another problem that the bottle system offers a solution for, is the dispensing of thick substances that have viscous properties. Sometimes these substances can be difficult to remove from their containers. What the bottle system offers is a solution for the removal of such substances in a more efficient and easy manner, by compressing them outward from within.

The bottle can be made of polyethylene terephthalate which is a common standard for soft drink bottles to date. Given the properties of polyethylene terephthalate the inner bladder liner can also be made of polyethylene terephthalate or a similar material, but with thinner walls. Experimentation will have to be conducted by the manufacturer.

SUMMARY

It is the objective of the invention to provide a vessel that will contain consumable liquids that have effervescent properties, such as carbonated soft drinks, effervescent wines, and beers. Further use of the invention can be employed when viscous substances will be the choice content of the invention. When effervescent drinks are the choice content used, the purpose of the invention is to remove the excess air that has been left in the bottle after it has been opened and partially used. This is achieved by rotating the base of a bottle that is connected to a tab at the bottom of an inner bladder liner that is contained inside a bottle. By removing the excess air from a bottle the contents are maintained fresher for a longer period of time, by preventing the carbonation properties of the content from expanding into the empty air space in the bottle.

When the contents of the bottle employ a viscous substance such as tooth paste, mayonnaise, ketchup, or caulking compounds, the bottle plays a different role. When the contents of the bottle have viscous properties, the bottle is designed to rotate the base either to the left or to the right. When the base is rotated, it actuates a tab at the bottom of the inner bladder liner inside the bottle. This rotation makes the tab turn by twisting the inner bladder liner inside the bottle. Twisting the inner bladder liner begins from the bottom first, forcing the contents in the bottle to move upward to the opening at the top of the bottle.

The ratchet and pawl effect created when the protrusions inside the base interface with the indents near the bottom of the bottle is designed to keep the base and the inner bladder liner where it is placed, and prevent them from moving on their own. This assures that the contents within the bottle will maintain a constant pressure upwards from below the bottle, thereby facilitating the removal of the contents in a most efficient and easier manner.

When the contents of the bottle is something of the nature of toothpaste, an opening near the top portion of the bottle's side wall is employed, (called bladder squeeze opening), to further remove the contents in a more controlled and in smaller amounts, by pressing the exposed portion of the inner bladder liner with the fingers.

DRAWING DESCRIPTION

Figure 7:
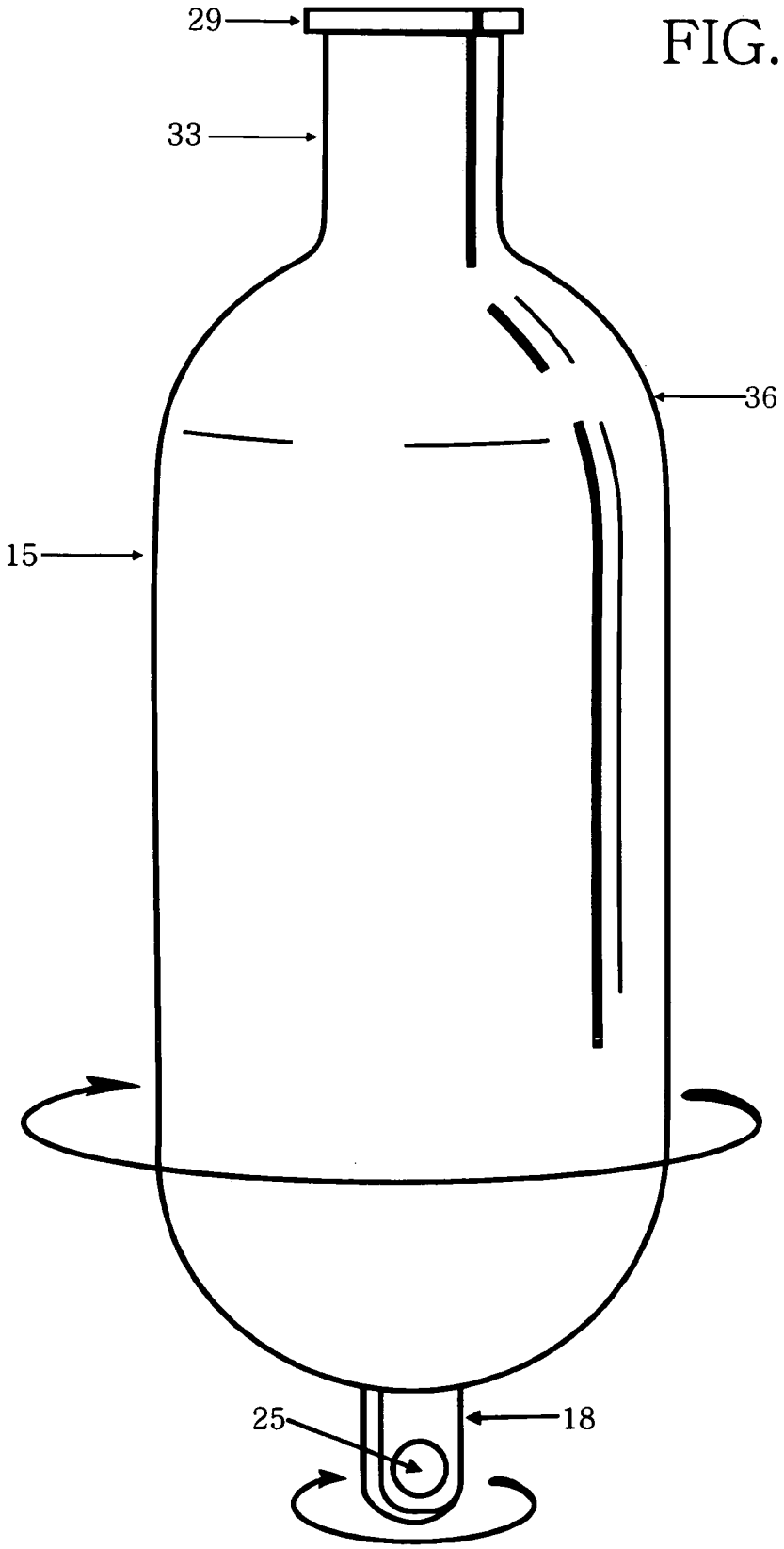

FIG. 7 shows an inner bladder liner that is fully inflated. It has a bladder rim at the top and below this rim it has the bladder neck. From the bladder neck, the inner bladder liner extends outward to form the bladder shoulder. The rest of the inner bladder liner extends straight downward, rounding off at the bottom and terminating into a tab with a node on both sides of the tab.

Figure 7A:
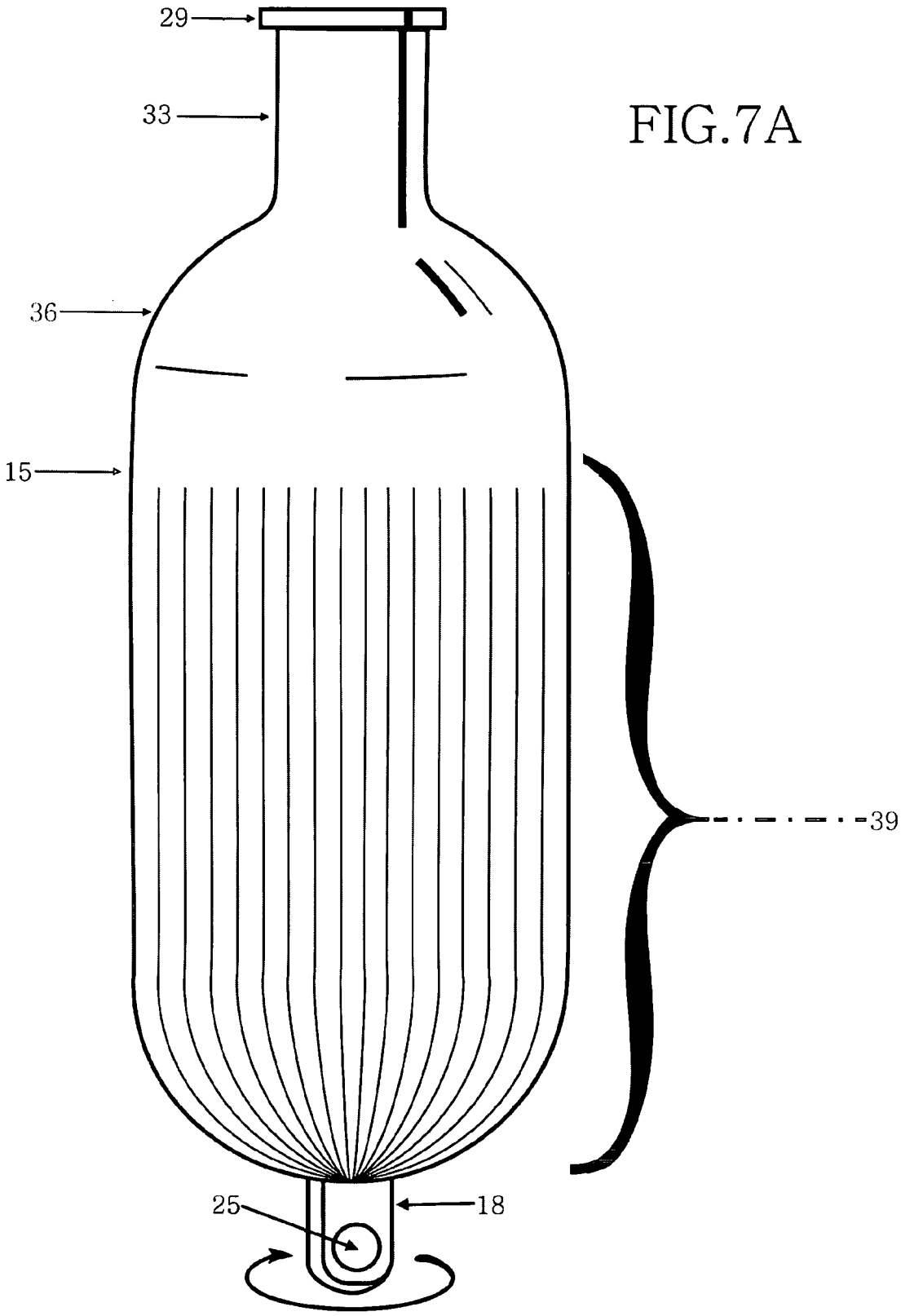

FIG. 7A is a view of an inner bladder liner incorporating an added benefit of scoring the liner.

Figure 8:
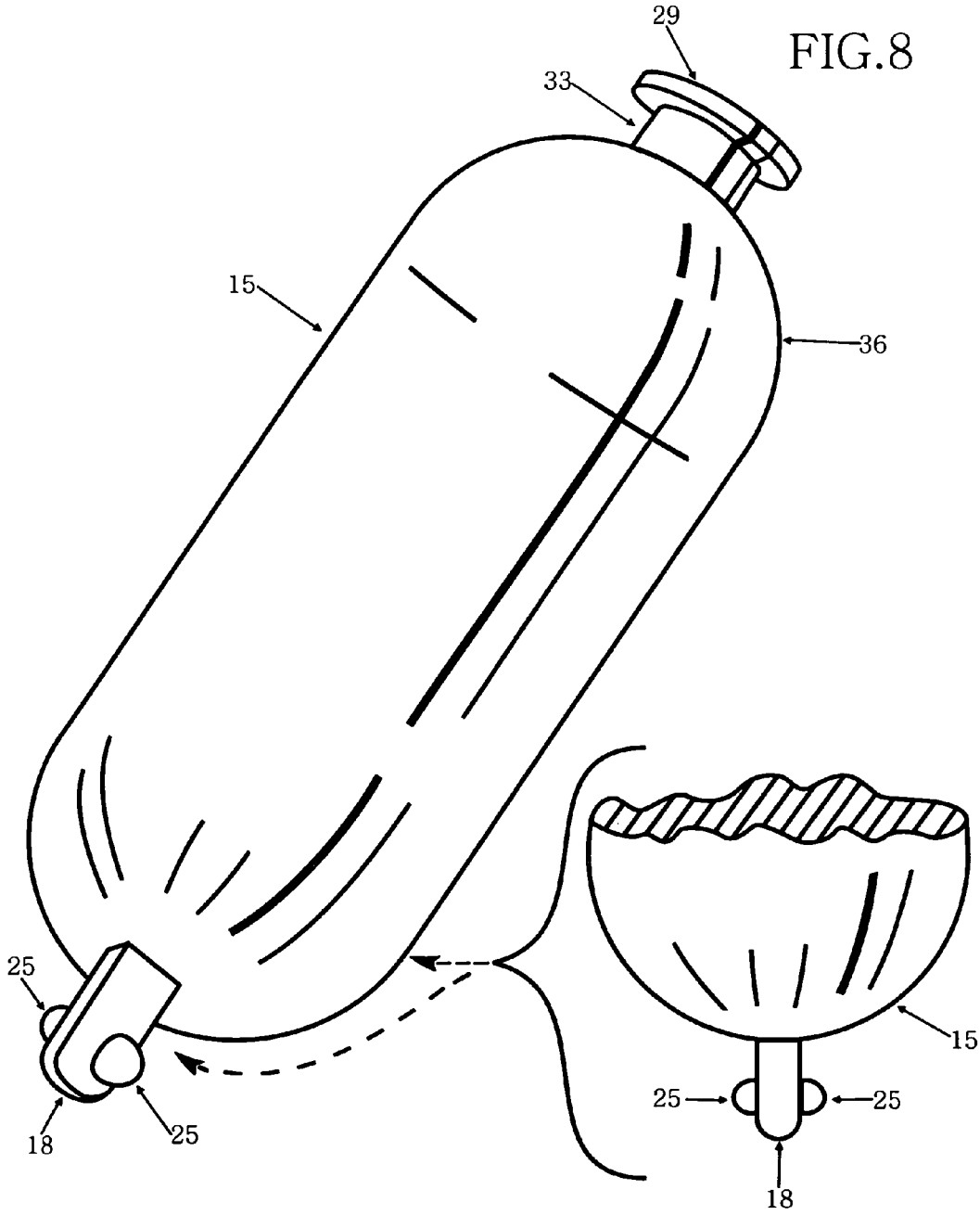

FIG. 8 is a view of an inner bladder liner, illustrating a separate cutaway view of a bottle, showing a different angle of the tab and nodes.

Figure 9:
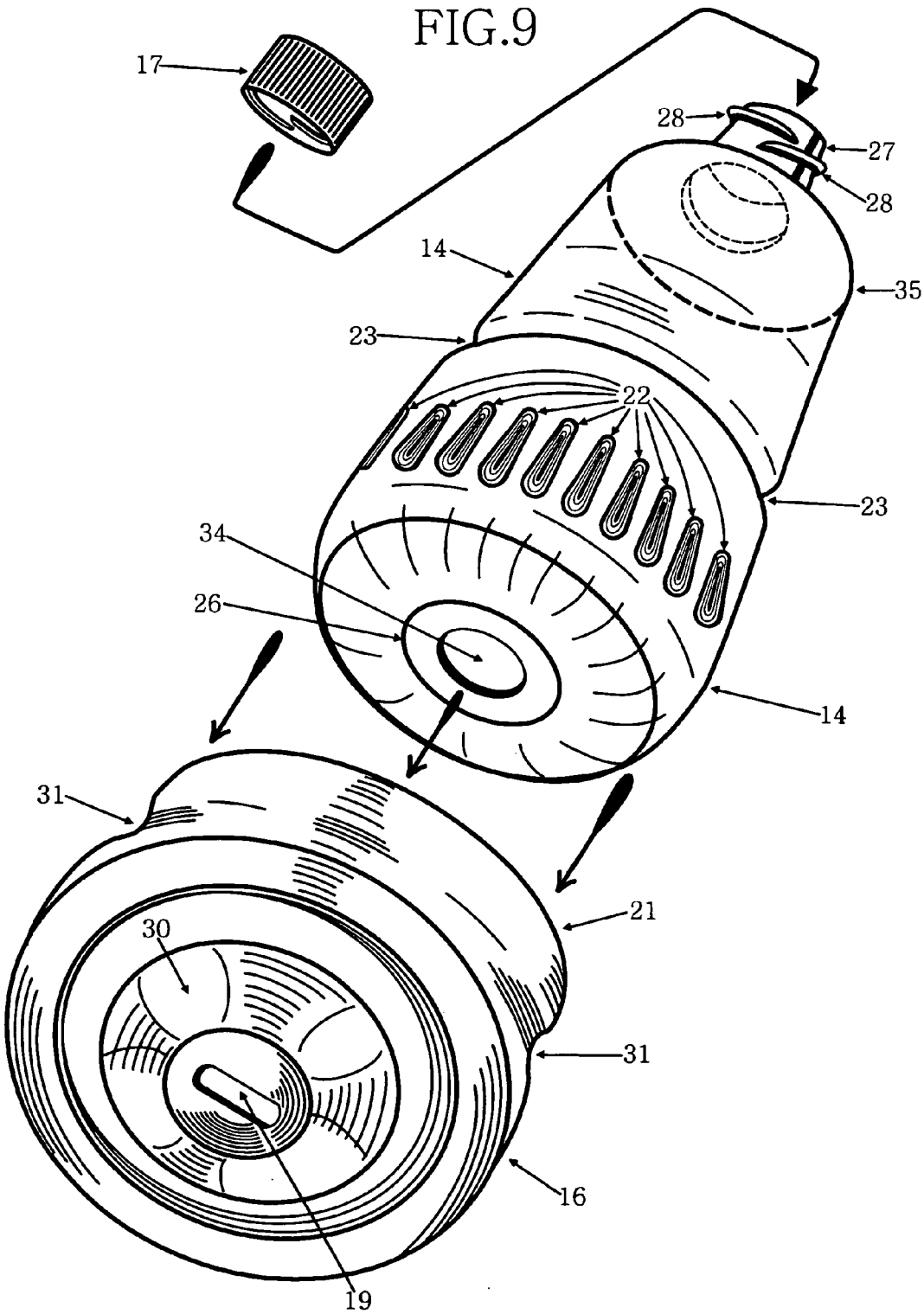

FIG. 9 is an exploded view of a bottle, a rotating base, and a twist off cap.

Figure 10:
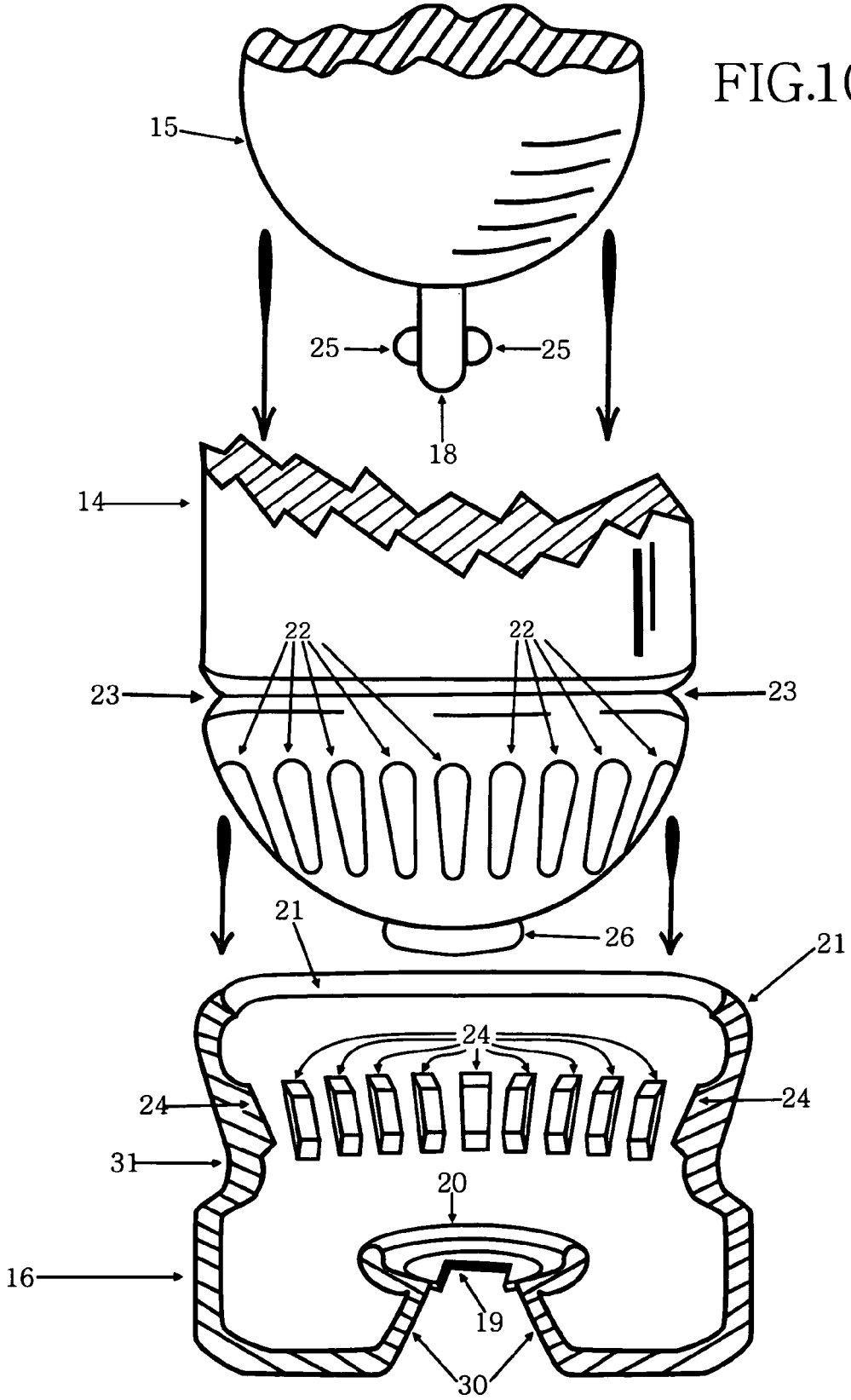

FIG. 10 is a cutaway view of an inner bladder liner at the top, with a cutaway view of a bottle at the center, and a cutaway view of a rotating base at the bottom of the page.

Figure 11:
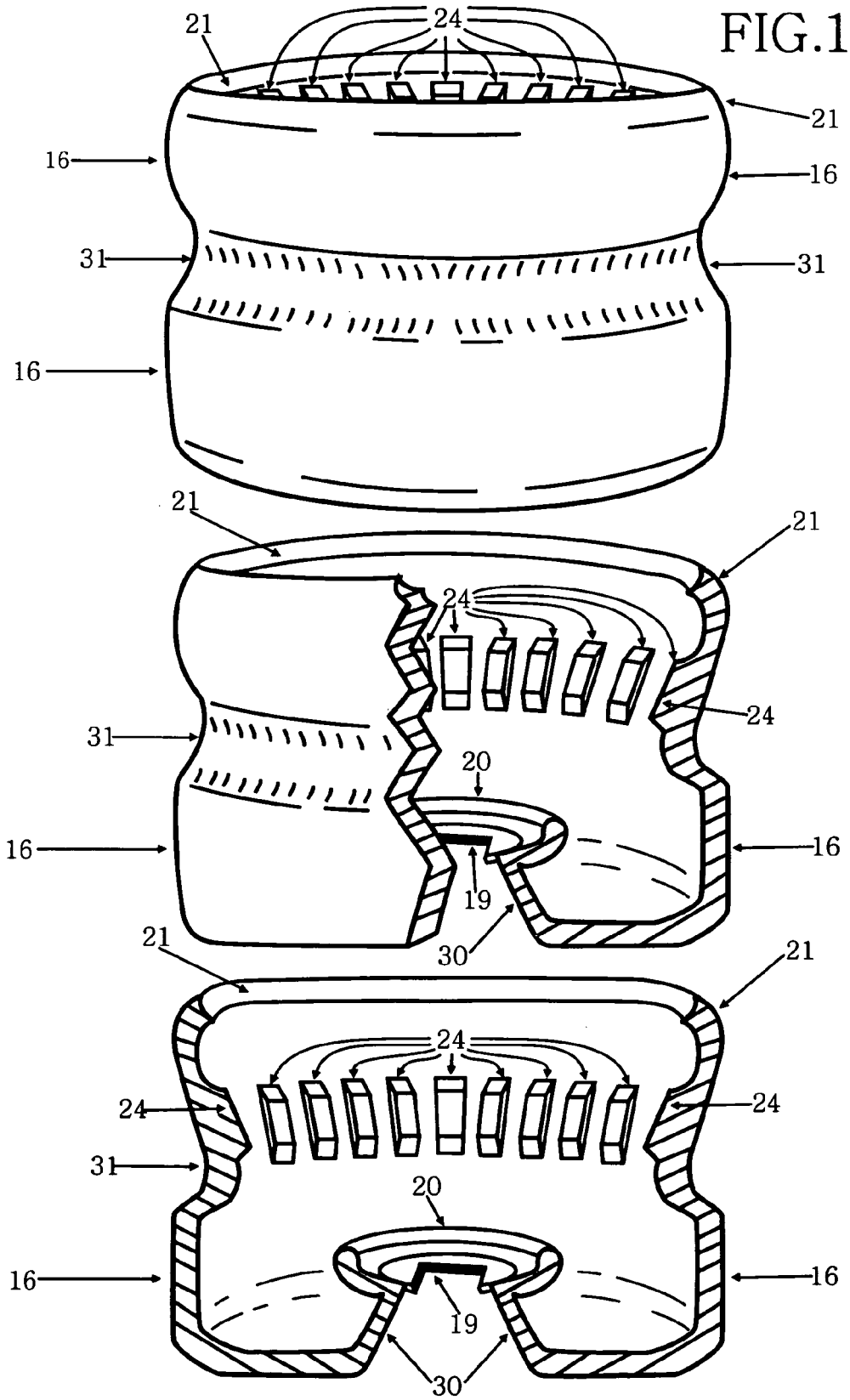

FIG. 11 is a view of a rotating base at the top of the page, with a partial cutaway view of a rotating base at the center, and a full cutaway view of a rotating base at the bottom of the page.

Figure 12:
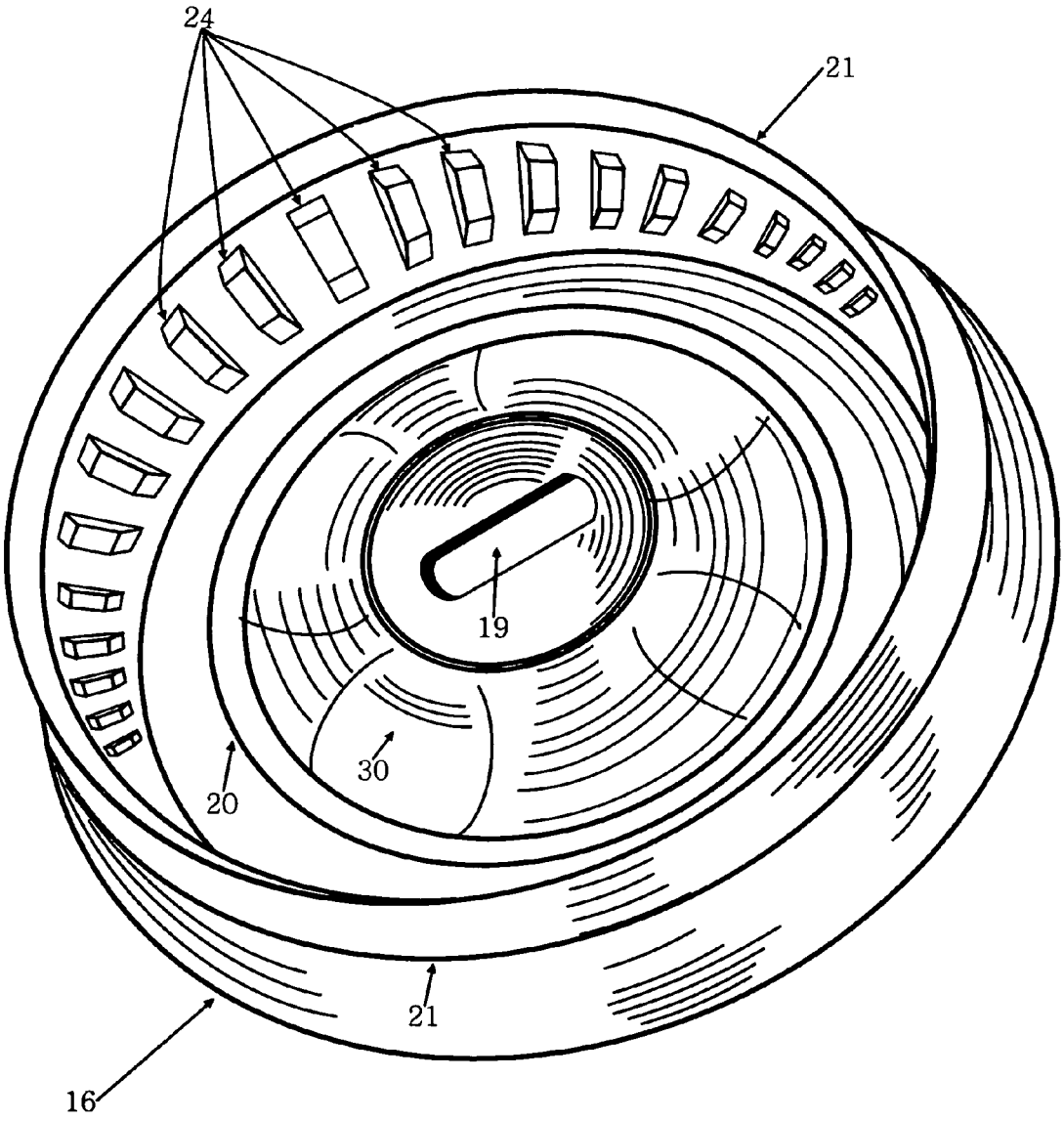

FIG. 12 is an inside view of a rotating base.

Figure 13:
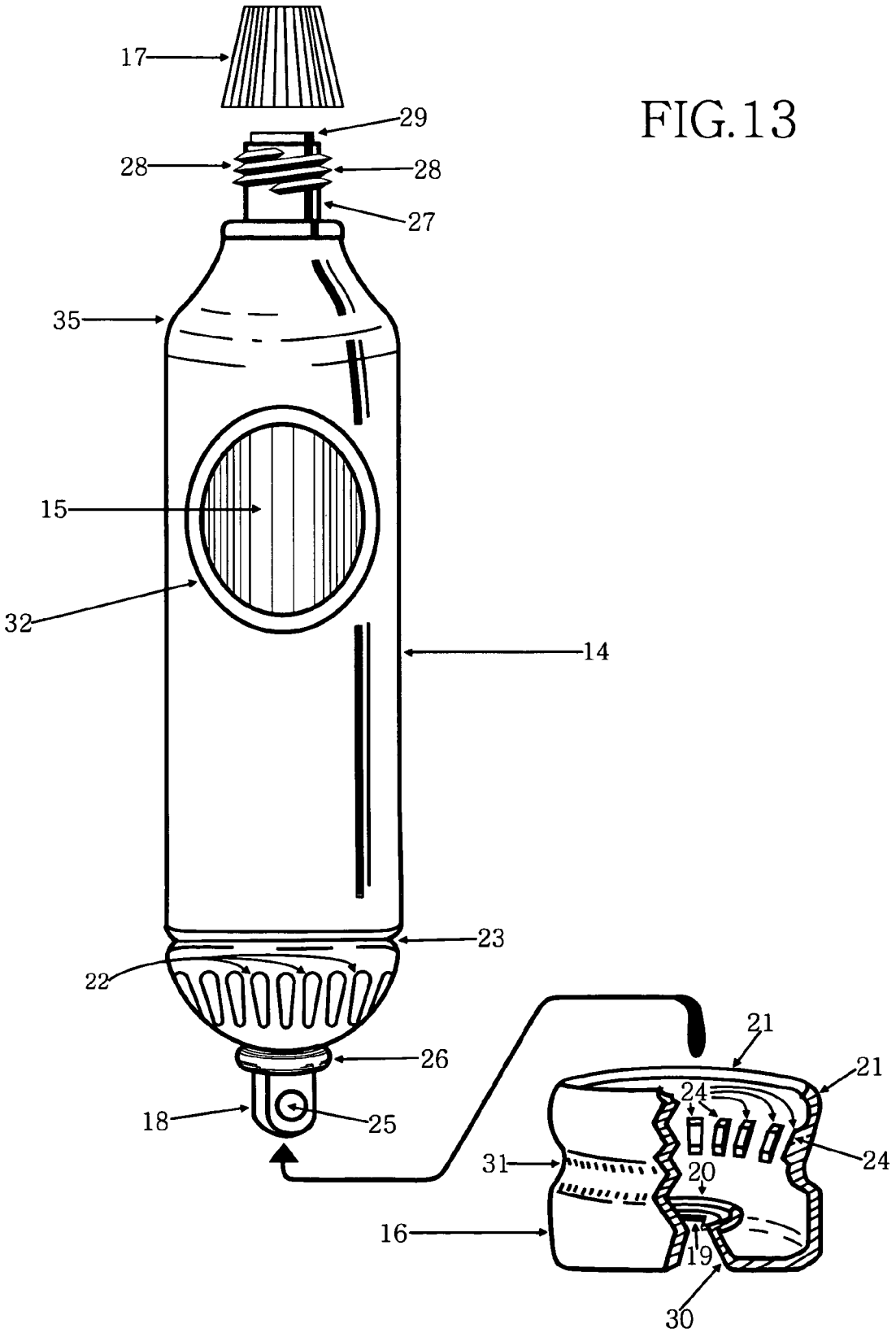

FIG. 13 is a view of a bottle with the rotating base and the cap removed and set aside, and further illustrates where the bladder squeeze opening is located on the side wall of a bottle.

Figure 13A:
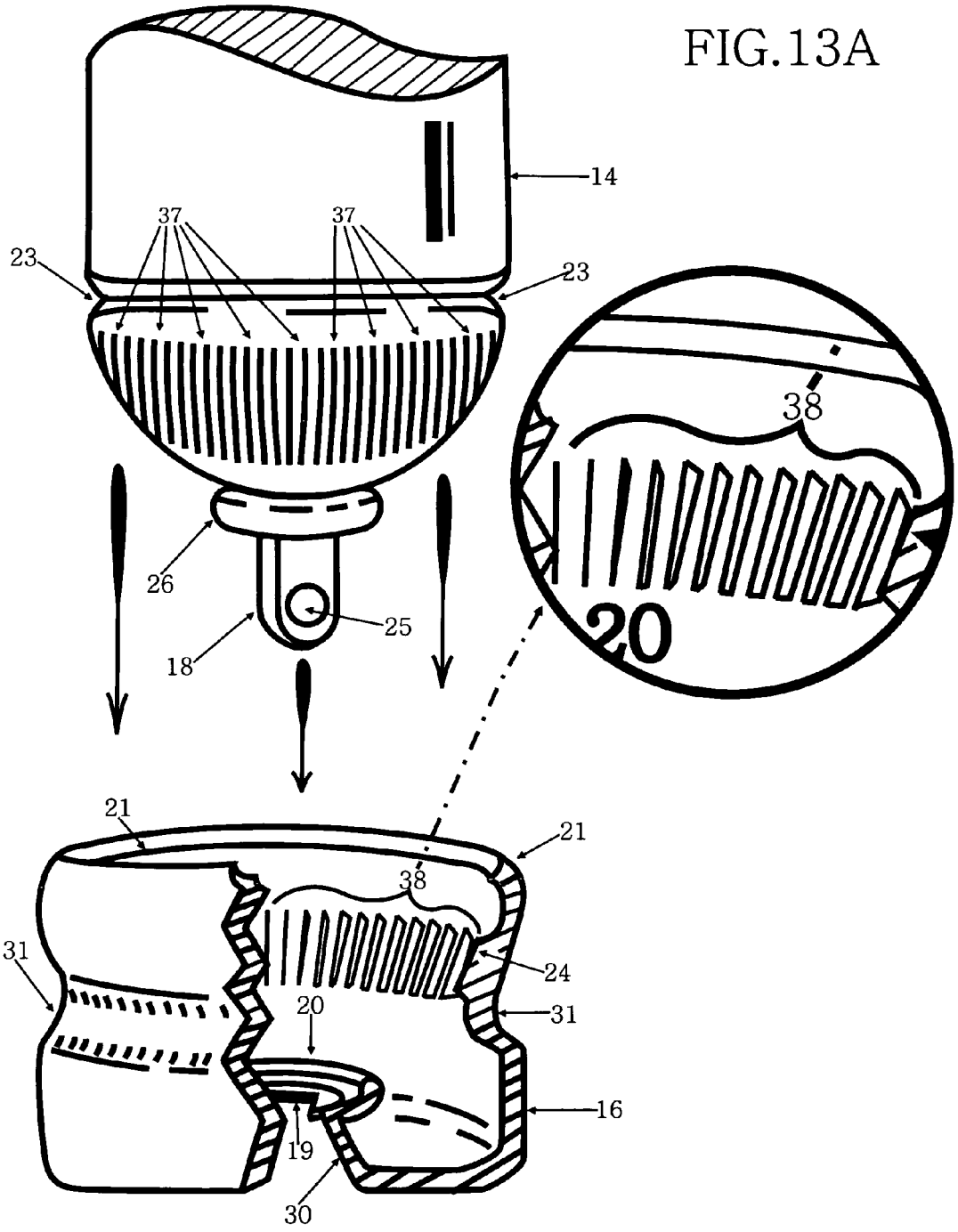

FIG. 13A is a cut away view of a bottle 14, and a rotating base 16, and further the bottle shows serration at the bottom portion. The base shows a partial cutaway view revealing serration on the inner wall. A magnified view of the serration is shown separately to further illustrate more clearly how the serration is fitted inside the rotating base.

DETAILED DISCRIPTION

FIGS. 1, 2, 3, 4, 5, 9, 13, show a bottle 14, made of polyethylene terephthalate, that can also be made of polypropylene or various other plastics depending on its intended contents. The bottle is intended for the storing and dispensing of effervescent drinks, but can also be used effectively for the storing and dispensing of viscous substances. The bottle is cylindrical in shape, tapering off into a rounded form at the bottom. The bottle has a shoulder 35, tapering into an elongated neck 27, at the top with the neck finally terminating into an opening. The neck of the bottle has threading 28, for the purpose of applying a screw-on cap 17. The bottle employs a system of indents 22. The indents work to restrict the movement of the rotating base 16, when they interface with the protrusions 24 located along the inside wall of the rotating base. The side of the rotating base is crimped, creating a base indentation 31. This is done to contour the rotating base inward bringing the protrusions in close proximity to the indents on the bottle. The purpose of the indents and the protrusions is to create a ratchet and pawl effect so that when the rotating base is moved it turns a tab 18, that is attached to the bottom of an inner bladder liner 15. When the tab is turned, the inner bladder liner is twisted beginning at the bottom first, thereby compressing the inner bladder liner and forcing the contents of the bottle to move upwards towards the threaded opening located at the top of the bottle. Once the said base is turned to a new position, it will be held there in this new position by the said indents and protrusions thereby keeping the said inner bladder liner from turning backwards on its own, and by so doing maintain a constant upward pressure of the contents.

This system is advantageous in the soft drink industry, because by removing the excess air in the bottle it keeps the contents in the bottle fresher for a longer period of time.

The bottle system also works well when it is used with thick or viscous substances. When the rotating base 16, is turned it forces these thick substances up towards the opening at the top of a bottle. By pre-squeezing the contents in a bottle and not allowing the contents to flow back into the empty air space that remains in a container, (when some of the initial contents have been expended), it allows for the removal of the contents in a more efficient manner. A good example of these contents is toothpaste, that is by nature more difficult to remove from a container.

Figure 1:
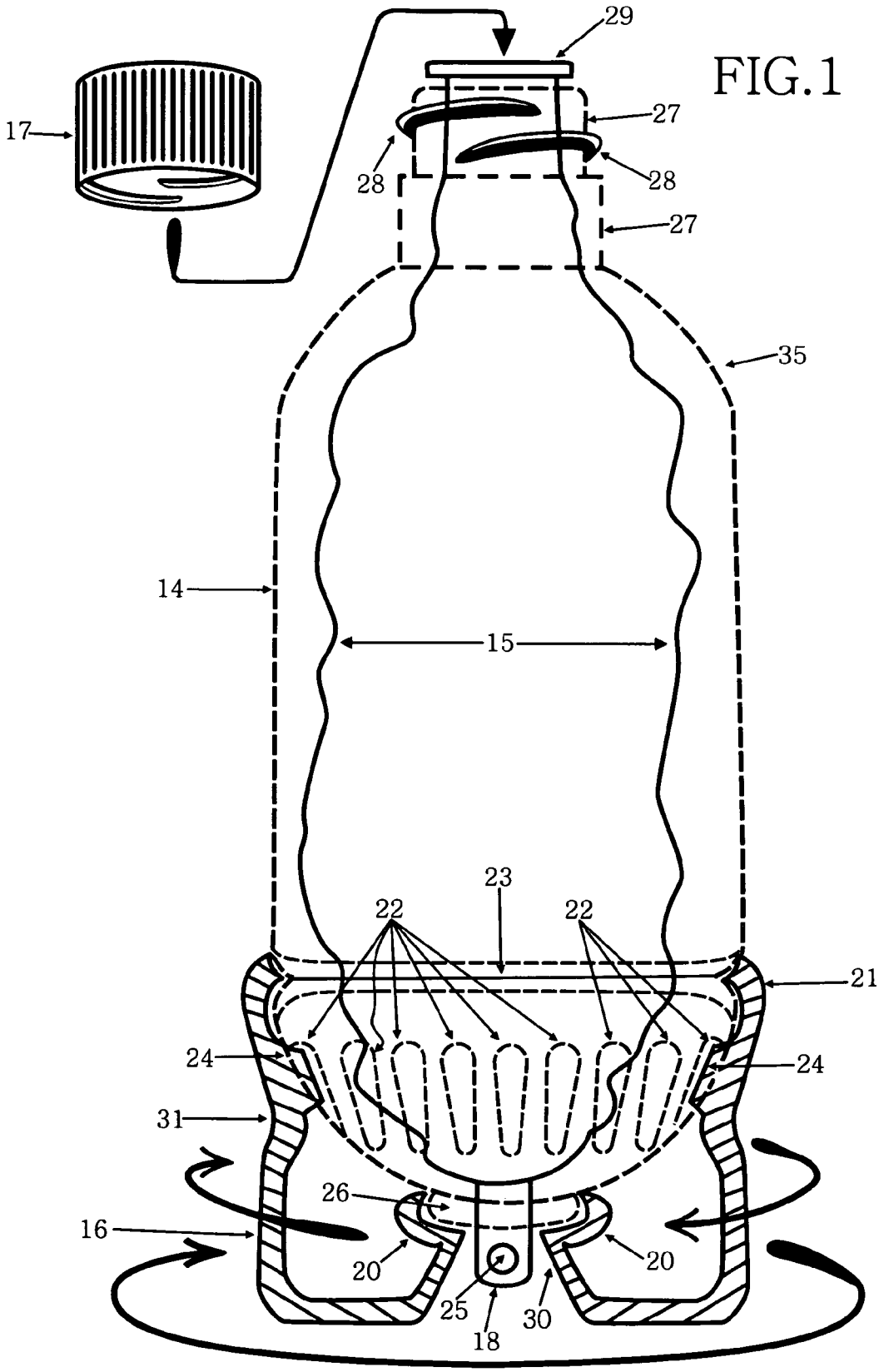
FIG. 1 shows a composite view of most of the parts of a bottle, with a cutaway view of the rotating base, and how they are interlocked with one another, and further illustrating with arrows how the rotating base is turned.
Figure 2:
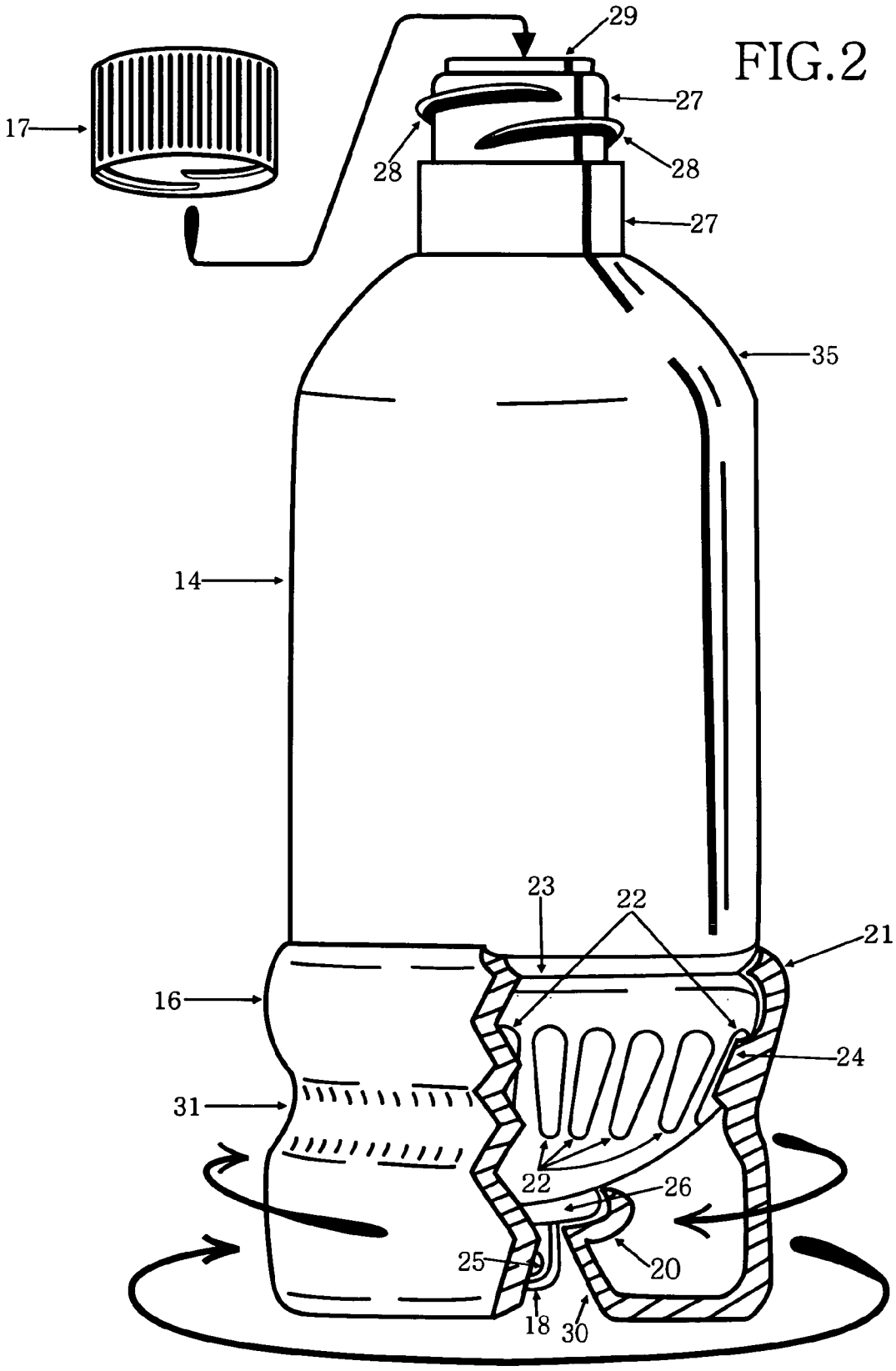
FIG. 2 shows a view of a bottle and a partial cutaway view of the rotating base, to further illustrate how the parts of the bottle interface with one another. It also gives an indication of how the rotating base is turned, as well as showing a screw-on cap.
Figure 3:
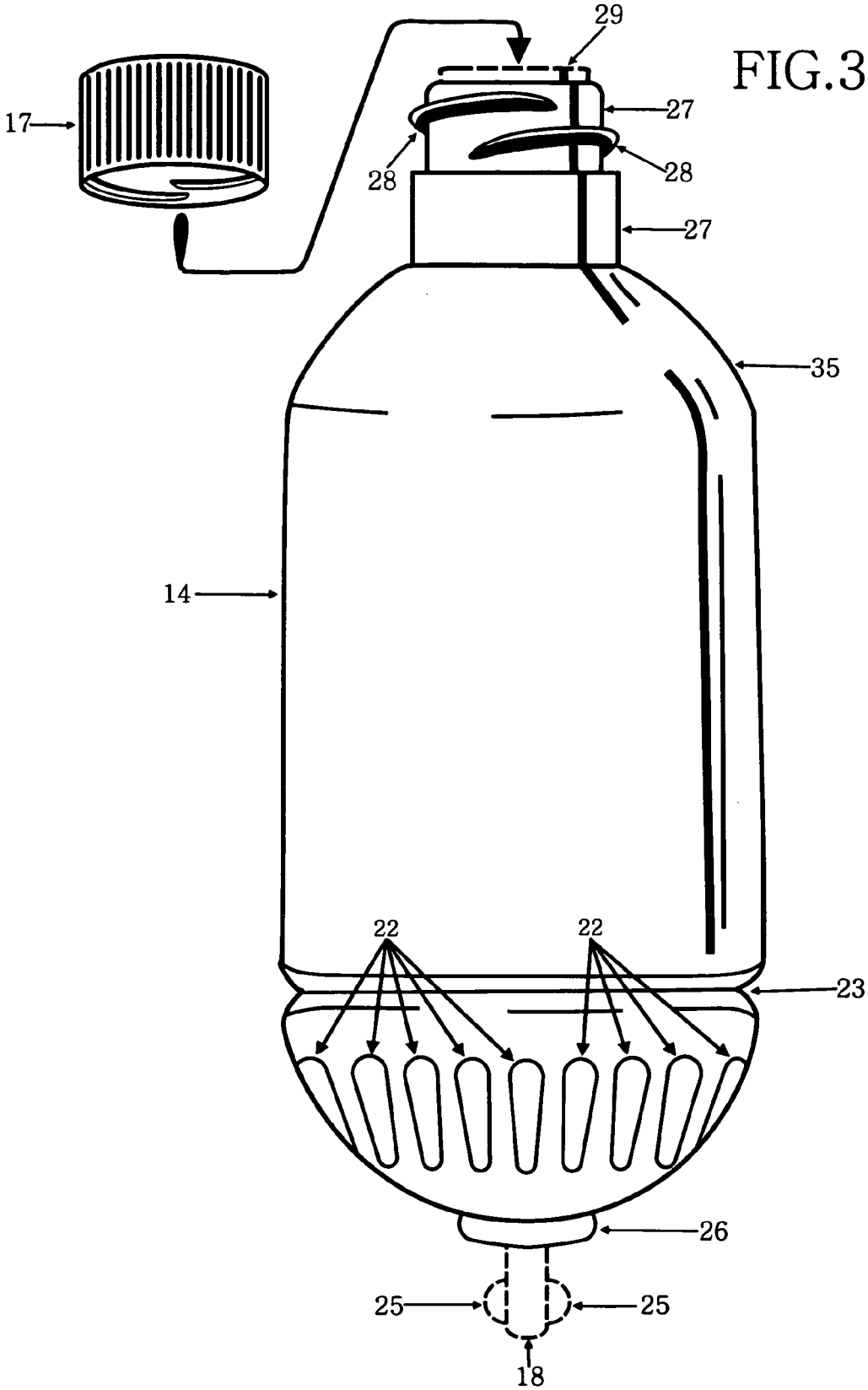
FIG. 3 is a view of a bottle with the bladder rim extruding from the top of a bottle, and the tab and nodes extruding from the bottom of a bottle.
Figure 4:
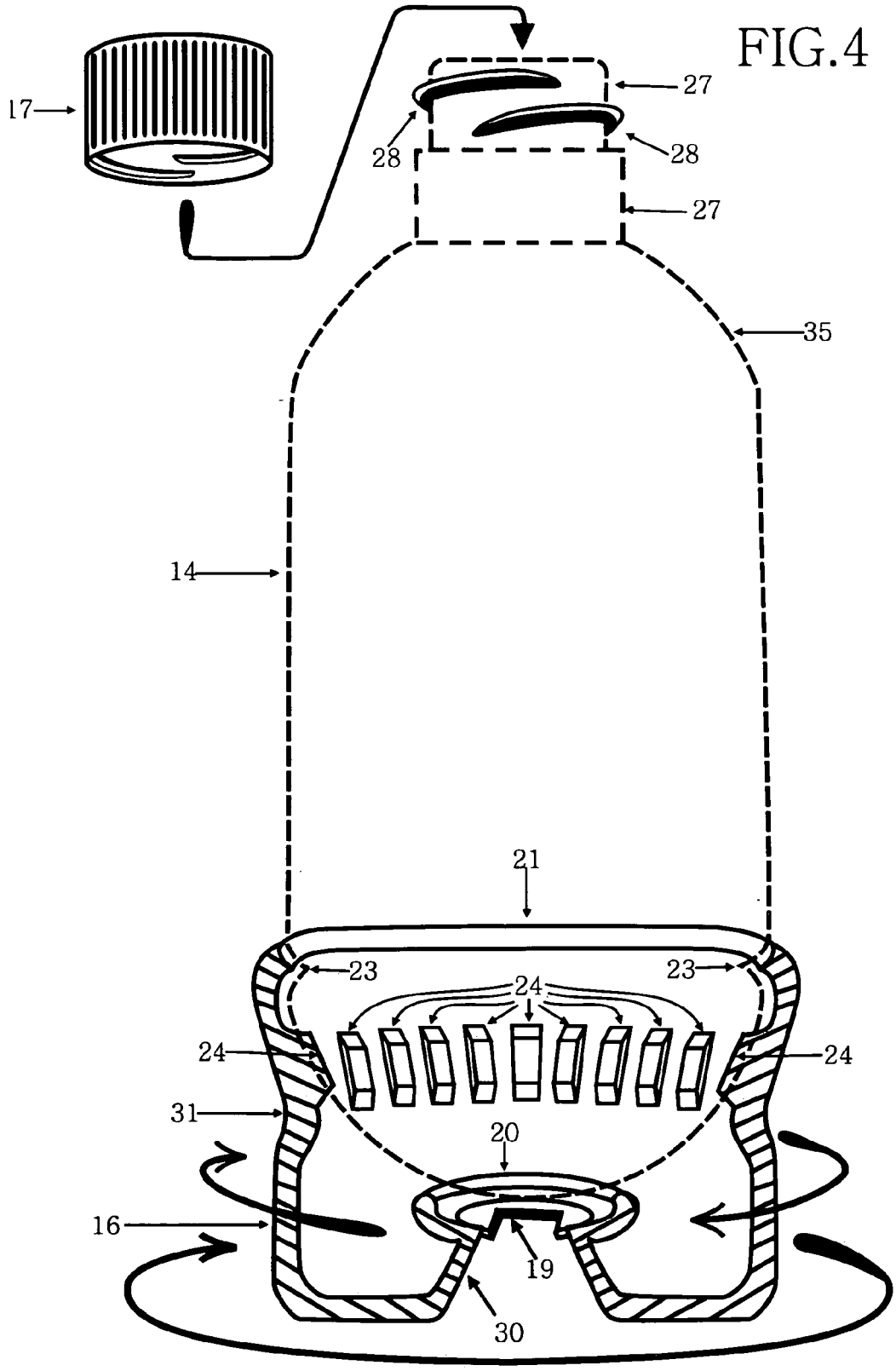
FIG. 4 is a cutaway view of a rotating base of a bottle showing how the protrusions of the base connect with said bottle.
Figure 5:
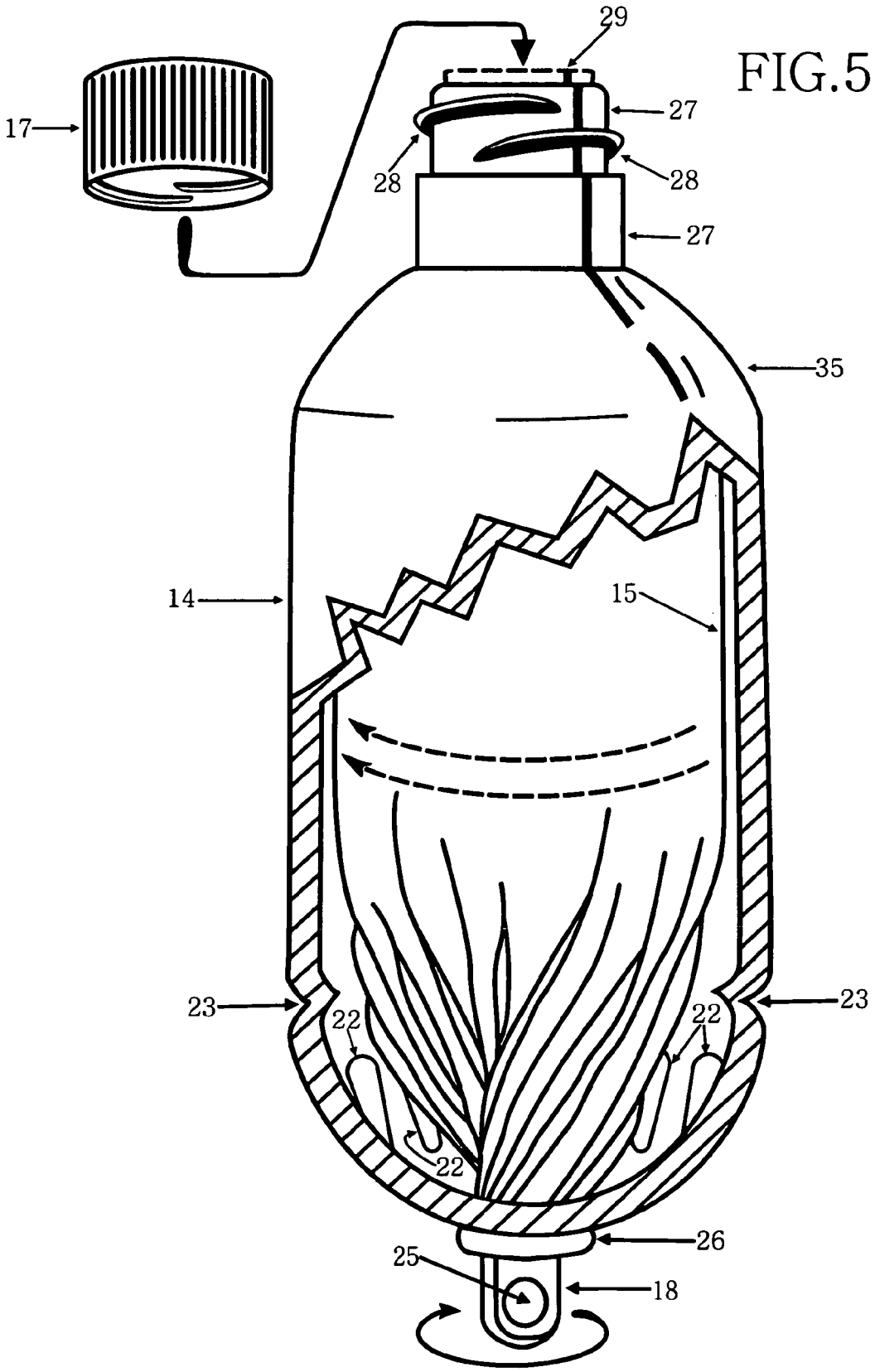
FIG. 5 illustrates how an inner bladder liner is located inside a bottle, and further indicating how it is twisted by revealing the bladder liner from a cutaway view of a bottle.
Figure 6:
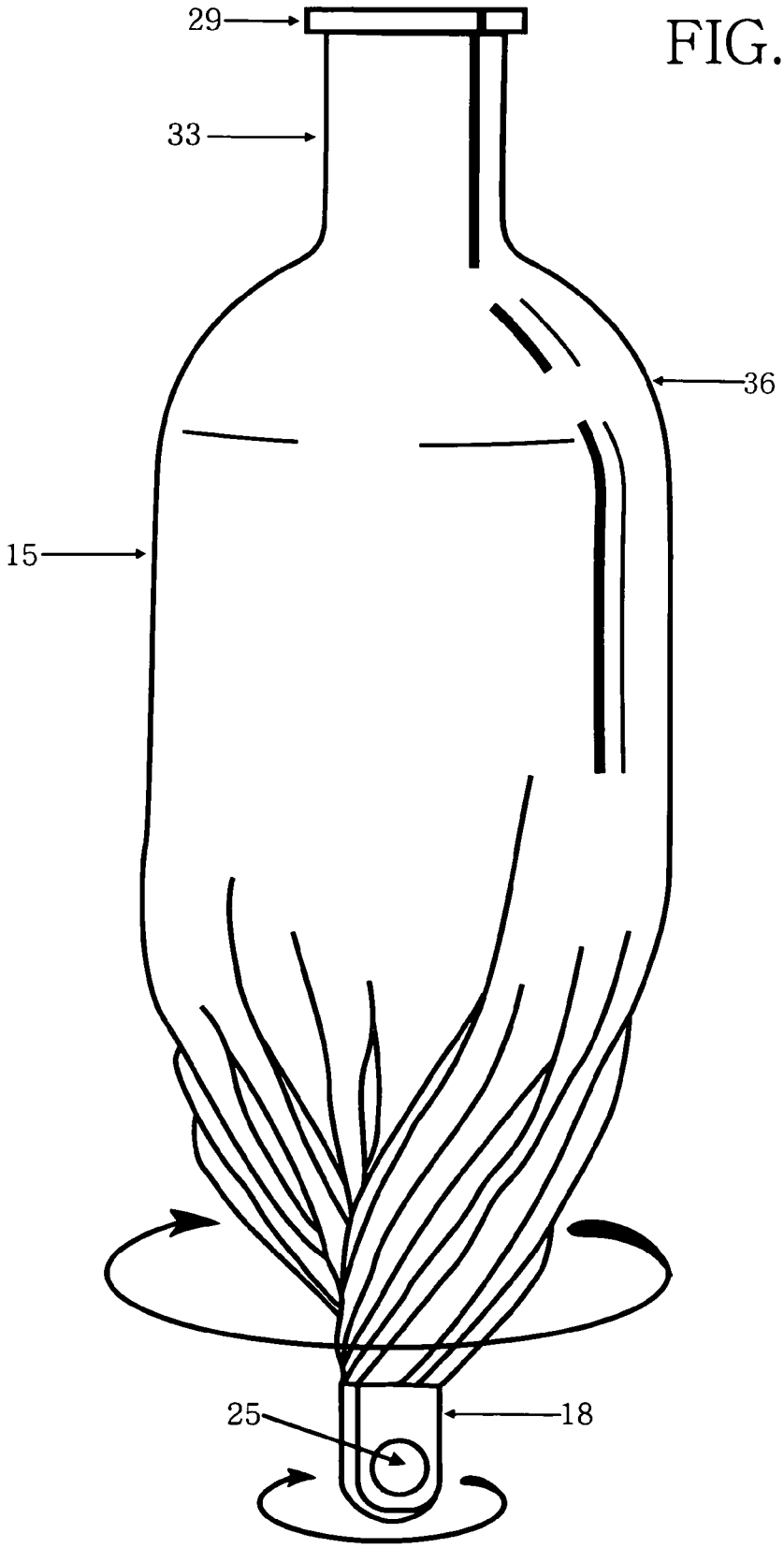
FIG. 6 is a view of an inner bladder liner partially twisted from the bottom.

FIGS. 1, 2, 4, show how the protrusions 24, on the rotating base 16, interface with the indents 22, on the bottle 14, to lock the base onto the bottle and keep it from turning on it own.

FIGS. 1, 2 show how the retaining ring 26, is cradled in the holding cup 20, with the tab 18, protruding through both the retaining ring and the holding cup.

FIG. 4, illustrate a view of a bottle 14, in dotted outline form. Also shown is a cutaway view of the rotating base 16, and a screw on cap 17. The purpose of this illustration is to show how the bottle 14, is engaged by the protrusions 24, on the base. Note how the protrusions 24, on the left and right of the bottle partially extend into the bottle. The said retaining ring at the bottom of the bottle has purposely been omitted from this view so as not to confuse it with the holding cup located on the bottom, inside, and center surface of the rotating base.

FIGS. 1, 5, 6, 7, 7*a*, 8, 10, 13, show an inner bladder liner 15. The inner bladder liner is a collapsible plastic bag that is inserted into a bottle, via the bottle neck 27, that is open at the top of the bottle. The inner bladder liner has a thin flat bladder rim 29, at the top opening of the inner bladder liner. The bladder rim supersedes in size the opening at the top of the said bottle where it can be heat onto the bottle. The bladder rim is designed so that it can rest on top of the bottle neck 27, therefore preventing the inner bladder liner from being pulled into the bottle. The inner bladder liner has a size and shape that is contoured to the inside surface of the bottle. The inner bladder liner consists of a bladder rim 29, a bladder neck 33, and bladder shoulder 36. The inner bladder liner has straight walls that taper into a rounded form at the bottom, and finally ending at the bottom of the inner bladder liner with a tab 18, that has a node 25, on both sides. The inner bladder liner can be further enhanced by scoring 39, it in such a way that the inner bladder liner will collapse like a billows when it is rotated, very much the same way an accordion is collapsed. The wall of the inner bladder liner can be scored more than half of its length, to facilitate in the twisting and collapsing of the inner bladder liner. It may also be preferable that the inner bladder liner be made of the same material polyethylene terephthalate as the bottle itself, but in a thinner gauge. Given the properties of polyethylene terephthalate of tinsel strength and its ability to maintain its shape with a minimal of stretching, it would keep the expansion of the inner bladder liner to a minimum.

FIGS. 1, 2, 3, 4, 5, 9, 10, 11, 12, 13, illustrate how the bottle 14, employs a flange groove 23, and flange 21, creating a system to guide and maintain the rotating base 16, of the bottle in its place. The rotating base is circumvented by a flange along the top rim. The flange is a tight fit that snaps onto a flange groove that encircles the lower portion of the bottle. The flange and flange groove assures that the bottle and rotating base maintain constant contact with one another without separating from each other. The flange and flange groove also serve as a guide for the rotating base when it is rotated around the bottle.

FIGS. 1, 2, 3, 5, 9, 10, 13, To further assure that the rotating base remains securely attached to the bottle, a retaining ring 26, is formed at the very bottom of the bottle.

FIGS. 1, 2, 4, 9, 10, 11, 12, 13, show how the retaining ring 26, is engaged by a holding cup 20, that is located on the inside and bottom center of the rotating base at the crest of the base depression 30. The retaining ring is snap-fitted onto the holding cup where it is firmly held in place. The holding cup and retaining ring further aid in guiding the rotating base when it is actuated.

FIG. 9, shows a retaining ring hole 34. The purpose of this hole is to allow the tab 18, to pass through it. The retaining ring hole is round in shape so that the tab may be turned freely without hindrance when it is inserted through the retaining ring hole.

FIGS. 9, 12, illustrate a tab hole 19, located at the center of the holding cup 20. This hole is rectangular in shape, elongated, and narrow to fit the shape and dimensions of the tab body. The tab is press fitted through the tab hole where it is engaged by the rotating base.

FIGS. 4, 10, 11 , 13, further illustrate a cutaway view of a tab hole 19, situated at the center of the holding cup 20.

FIGS. 1, 2, 4, 9, 10, 11, 12, 13, show the base depression 30. The base depression is a portion of the base that is raised into the inside part of the base located at the bottom of the base. Its purpose is to raise the holding cup up to the bottle so that it can engage with the tab 18, that extends downward from the bottom of the bottle.

FIGS. 1, 2, 3, 5, 6, 7, 8, 10, 13, illustrate the nodes 25, on the tab 18. The nodes sole purpose is to assure that the tab 18, is not drawn up into the bottle 14, after the inner bladder liner 15, is twisted inside the bottle. This is achieved by forcing the tab and nodes through the tab hole located on the top of the base depression 30 of the rotating base 16. Once the tab and nodes are pressed through the tab hole, the tab hole 19, restricts the tab from sliding back up into the bottle, by catching the nodes on the outside and bottom surface of the tab hole.

FIG. 10, shows a cutaway view of an inner bladder liner 15, at the top of the page. This is indicated with arrows to show how the inner bladder liner will be joined with the bottle 14, illustrated as a cutaway view at the center of the page. At the bottom of the page is a cutaway view of the rotating base also indicating with arrows to show how the bottle will fit into the base. Once the inner bladder liner is inserted into the bottle, said tab 18, and nodes 25, will protrude from the bottom center of the bottle through the retaining ring hole 34. When the inner bladder liner is in place, the bottle is lowered and press fitted onto the rotating base where the flange 21, and flange groove 23, lock the bottle onto the rotating base. At this stage the bottle is also locked into place by the retaining ring 26, and holding cup 20. Once this is achieved the tab 18, is locked into place in the tab hole 19.

FIG. 13, shows a view of a bottle 14, with the rotating base 16, and cap 17, set aside. Further illustrating a bladder squeeze opening 32, located on the side wall of a bottle. The purpose of the bladder squeeze opening is to facilitate in the removal of the contents in the bottle, when the contents are of a viscous substance. This is very useful for a more controlled removal of products like toothpaste. When the contents in the bottle are depleted, the rotating base is turned to push the contents in the bottle upward. Once the contents are compressed to a desired level by the user, the inner bladder liner 15, can be pressed with the fingers through the bladder squeeze opening 32, to facilitate in the removal of the contents in the bottle in smaller and more controlled amounts.

FIG. 13A, shows a cutaway view of a bottle 14, indicated by three vertical arrows pointing downward to illustrate how the bottle will be lowered into the base 16. It also shows a variation of the ratchet and pawl effect of the bottle by producing base serration 38, on the inside wall of the base 16, as well as bottle serration 37, near the bottom of the bottle that match and complement the serration on the base. This provides greater control of how far the base can be turned in smaller increments. The illustration also shows a magnified view of the base serration to indicate where and how the base serration is located in the base.

The invention claimed is:

1. A bottle assembly comprising:
- an outer bottle body comprising:
  - a hemispherical bottom wall having:
    - a plurality of radial serrations;
    - a retaining ring defining a central hole;
  - an open top;
  - a threaded neck finish surrounding said open top;
  - a cylindrical sidewall extending upwardly from said hemispherical bottom wall to said threaded neck finish, said cylindrical sidewall, said threaded neck finish, said open top, and said closed bottom collectively defining an interior compartment;
- an inner bladder for containing beverages, said inner bladder comprising:
  - an open top;
  - a liner body entirely housed within said interior compartment;
  - a closed base having a central portion;
  - a peg extending downwardly from said central portion and protruding through said central hole of said hemispherical bottom wall;
- a cap removably attached to said threaded neck finish for closing said interior compartment;
- a rotating collar removably attached to said hemispherical bottom wall, said rotating collar comprising:
  - a base comprising:
    - an annular bottom wall;
    - a central protrusion extending upwardly from said annular bottom wall, said central protrusion having an upper surface with an outer lip supporting said retaining ring of said hemispherical bottom wall and an inner opening receiving said peg of said inner bladder;
  - a circumferential sidewall extending upwardly from said annular bottom wall, said circumferential sidewall having a plurality of ribs protruding inwardly from an inner surface, said plurality of ribs cooperating with said plurality of serrations to form a ratcheting mechanism.

2. The bottle assembly according to claim 1, wherein said plurality of radial serrations comprise a series of indents and protrusions.

3. The bottle assembly according to claim 1, wherein rotating said rotating collar operates said ratcheting mechanism, causing said peg to turn and thereby twist said inner bladder.

4. The bottle assembly according to claim 1, wherein said inner bladder further comprises a rim surrounding said open top and proximal to said open top.

5. The bottle assembly according to claim 1, said peg further comprising sides with nodes.

6. The bottle assembly according to claim 1, said liner body further comprising a plurality of scoring for initiating collapse of said liner body.

7. The bottle assembly according to claim 1, said cylindrical sidewall further comprising a circumferential groove proximal to said hemispherical bottom.

8. The bottle assembly according to claim 1, wherein each of said plurality of radial serrations extend in a substantially axial direction and each of said plurality of ribs extend in a substantially axial direction.

9. The bottle assembly according to claim 1, wherein said rotating collar encloses said hemispherical bottom entirely.

10. The bottle assembly according to claim 1, said circumferential sidewall further comprising an upper flange with a circumferential lip defining an open upper end of said rotating collar.

11. The bottle assembly according to claim 1, wherein said plurality of ribs are proximal to a midpoint of said circumferential sidewall.

12. The bottle assembly according to claim 1, said cylindrical sidewall of said bottle further comprising a squeeze opening.

* * * * *